US011703230B2

(12) United States Patent
Jang et al.

(10) Patent No.: US 11,703,230 B2
(45) **Date of Patent: *Jul. 18, 2023**

(54) LIGHT EMITTING DEVICE IN DOOR FOR COOKING APPLIANCE AND COOKING APPLIANCE INCLUDING THE SAME

(71) Applicant: LG Electronics Inc., Seoul (KR)

(72) Inventors: Seungtae Jang, Seoul (KR); Yoonji Lee, Seoul (KR); Jae Myung Lim, Seoul (KR)

(73) Assignee: LG Electronics Inc., Seoul (KR)

( * ) Notice: Subject to any disclaimer, the term of this patent is extended or adjusted under 35 U.S.C. 154(b) by 200 days.

This patent is subject to a terminal disclaimer.

(21) Appl. No.: 17/107,591

(22) Filed: Nov. 30, 2020

(65) Prior Publication Data

US 2021/0080116 A1 Mar. 18, 2021

Related U.S. Application Data

(63) Continuation of application No. 16/021,340, filed on Jun. 28, 2018, now Pat. No. 10,883,726.

(30) Foreign Application Priority Data

Jun. 28, 2017 (KR) ..... 10-2017-0082076
Jun. 11, 2018 (KR) ..... 10-2018-0066924

(51) Int. Cl.
*F24C 15/02* (2006.01)
*F24C 15/00* (2006.01)
(Continued)

(52) U.S. Cl.
CPC ..... *F24C 15/008* (2013.01); *A47L 15/4257* (2013.01); *A47L 15/4293* (2013.01);
(Continued)

(58) Field of Classification Search
CPC ..... F24C 15/008; F24C 7/082; F24C 15/02; F24C 15/04; A47L 15/4257; A47L 15/4293
See application file for complete search history.

(56) References Cited

U.S. PATENT DOCUMENTS 10,883,726 B2 * 1/2021 Jang ..... F24C 15/04
2004/0264168 A1 12/2004 Gotz et al.
(Continued)

FOREIGN PATENT DOCUMENTS

DE 10259762 7/2004
DE 102004062751 7/2006
(Continued)

OTHER PUBLICATIONS

EP Extended European Search Report in European Appln. No. 20205460.7, dated Feb. 24, 2021, 9 pages.
(Continued)

*Primary Examiner* — Alfred Basichas
(74) *Attorney, Agent, or Firm* — Fish & Richardson P.C.

(57) ABSTRACT

A light-emitting device is provided for a cooking appliance that includes a body that defines a cooking chamber having an opening, and a door configured to open and close at least a portion of the opening of the cooking chamber. The light-emitting device includes a light-emitting member that is located on at least one of the door or the body, that faces a gap defined between an edge portion of the door and a front portion of the body, and that is configured to emit light of a predetermined color in response to operation of the cooking chamber, and a reflective portion that extends from the front portion of the body, that is configured to receive light from the light-emitting member through the gap, and that is configured to direct light in a direction away from the door.

19 Claims, 9 Drawing Sheets

(51) Int. Cl.

| | |
|---|---|
| ***A47L 15/42*** | (2006.01) |
| ***F24C 7/08*** | (2006.01) |
| ***F24C 15/04*** | (2006.01) |

(52) U.S. Cl.
CPC ..... *F24C 7/082* (2013.01); *F24C 15/02* (2013.01); *F24C 15/04* (2013.01)

(56) References Cited

U.S. PATENT DOCUMENTS

| | | | |
|---|---|---|---|
| 2011/0215688 | A1 | 9/2011 | Jang |
| 2013/0027214 | A1 | 1/2013 | Eng et al. |
| 2013/0134846 | A1 | 5/2013 | Busing et al. |

FOREIGN PATENT DOCUMENTS

| | | |
|---|---|---|
| DE | 102005047915 | 4/2007 |
| EP | 0691100 | 1/1996 |
| EP | 2552292 | 2/2013 |
| EP | 2977682 | 1/2016 |
| JP | 2007098000 | 4/2007 |
| JP | 2011007494 | 1/2011 |
| KR | 1020080037408 | 4/2008 |
| KR | 1020090085982 | 8/2009 |
| WO | WO03036176 | 5/2003 |
| WO | WO2010001190 | 1/2010 |
| WO | WO2011117044 | 9/2011 |

OTHER PUBLICATIONS

European Extended Search Report in European Application No. 18180282.8, dated Nov. 13, 2018, 9 pages.
European Office Action in European Application No. 18180282.8, dated Oct. 16, 2019, 7 pages.

* cited by examiner

LIGHT EMITTING DEVICE IN DOOR FOR COOKING APPLIANCE AND COOKING APPLIANCE INCLUDING THE SAME

CROSS-REFERENCE TO RELATED APPLICATIONS

This application is a continuation of U.S. application Ser. No. 16/021,340, filed on Jun. 28, 2018, which claims the priority of Korean Patent Application No. 10-2017-0082076, filed on Jun. 28, 2017, and Korean Patent Application No. 10-2018-0066924, filed on Jun. 11, 2018, in the Korean Intellectual Property Office, the disclosures of which are hereby incorporated by reference in their entirety.

TECHNICAL FIELD

The present disclosure relates to a light-emitting device for a cooking appliance and a cooking appliance having the same.

BACKGROUND

A cooking appliance is a household appliance that can cook food. For example, the cooking appliance may be located in a kitchen space to cook food according to a user's intention. The cooking appliance may be classified into various types depending on a heat source type, a fuel type, or an openness of a space that receives food.

Depending on the openness of a space in which food is placed, the device may be classified into an open type or a sealed type cooking appliance. For example, the sealed type cooking appliance includes a microwave oven, and the open type cooking appliance includes a cooktop and a hob.

In the sealed type cooking appliance, the space for accommodating food is closed and heated to cook food. The sealed type cooking appliance may have a cooking chamber that is a closed space in which food is placed and cooked. The cooking chamber may be opened and closed by a door disposed in front of the cooking chamber. A heat source is provided in an inner or outer position of the cooking chamber to heat the cooking chamber. For example, a gas burner, an electric heater, or the like may be used as a heat source.

In some cases, the cooking appliance may provide a visual effect, which may increase user satisfaction in using the cooking appliance. In some cases, the visual effect may increase interest of the user in food being cooked.

In some examples, a cooking appliance may include an illumination device. For example, the illumination device may be disposed on a rear surface of a door glass, where light may be transmitted through the door glass. A color of the illumination may vary based on a cooking mode.

In some examples where an illumination device for the cooking appliance transmits light through the door glass and emits light to an outside of the door, the color or illumination of light may be distorted due to the glass that allows penetration of light. In some cases, a light-emitting unit is located on a rear face of the door and emits light toward a door front face. In some cases, the light-emitting unit may be exposed through the outer face of the cooking appliance to a user, which may deteriorate aesthetics.

It is of interest to have a cooking appliance including a structure in a light emission path that allows light to reflect to a specific direction or that prevents light from being diffused in unnecessary directions, which may make clear illumination.

In some cases, an illumination unit may face a cavity such as the cooking chamber. It is of interest to cool the illumination unit to reduce a failure of the illumination unit or to improve durability of the illumination unit.

SUMMARY

One purpose of the present disclosure is to provide a light-emitting device and a cooking appliance equipped therewith in which a structure in which light is transmitted through the door glass and emitted to the outside of the door is not employed, so that the distortion of the color and the illumination of the light are suppressed.

Another purpose of the present disclosure is to provide a light-emitting device in a door and a cooking appliance equipped therewith in which the light is clearly emitted outside the door through a gap between a door edge portion and a portion of a body front face.

Still another purpose of the present disclosure is to provide a light-emitting device in a door and a cooking appliance equipped therewith, which allows the user to view the light emitted through the gap between the door edge portion and the portion of the body front face, such that the user intuitively confirms an operation status of the cooking appliance and operation information of the cooking chamber, and, a mood illumination function is realized.

Still another purpose of the present disclosure is to provide a light-emitting device in a door and a cooking appliance equipped therewith, in which a light-emitting member emitting light is not directly exposed to the outside of the door through the door, thereby to improve the aesthetics of the appliance.

Still another purpose of the present disclosure is to provide a light-emitting device in a door and a cooking appliance equipped therewith, in which a cooling function for cooling the light-emitting member is provided in order to allow the light-emitting member located in one face portion of the door for opening and closing the cooking chamber to be less susceptible to a high temperature environment of the cooking chamber.

According to one aspect of the subject matter described in this application, a light-emitting device is provided for a cooking appliance that includes a body that defines a cooking chamber having an opening, and a door configured to open and close at least a portion of the opening of the cooking chamber. The light-emitting device includes a light-emitting member that is located on at least one of the door or the body, that faces a gap defined between an edge portion of the door and a front portion of the body, and that is configured to emit light of a predetermined color in response to operation of the cooking chamber, and a reflective portion that extends from the front portion of the body, that is configured to receive light from the light-emitting member through the gap, and that is configured to direct light in a direction away from the door.

Implementations according to this aspect may include one or more of the following features. For example, the light-emitting member may be located at a surface of the door that faces the gap. In some examples, the light-emitting member is located at a front surface of the body that faces the gap. In some examples, the light-emitting device may further include an extension that extends from the reflective portion toward the door. In some implementations, the door includes an outer door unit that defines an exterior of the door and that is located at an opposite side of the cooking chamber, and an inner door unit that is located at a rear side of the outer door unit and that is configured to close the cooking chamber.

In some implementations, the outer door unit may further include a door protrusion that protrudes in a first direction further than the inner door unit and that is spaced apart from the inner door unit in a second direction transverse to the first direction. For instance, the first direction may be a vertical direction, and the second direction may be a horizontal direction. In some implementations, the door may further include a door frame that couples the outer door unit to the inner door unit and that is located between the outer door unit and the inner door unit. The outer door unit may include an outer glass that defines a front surface of the door, and the inner door unit may include an inner glass that defines a rear surface of the door, that is spaced apart from the outer glass, and that is configured to close the opening of the cooking chamber. The light-emitting device may further include a display assembly located in an inner upper position of the door frame.

In some implementations, the light-emitting member includes a light-emitting unit configured to emit light, and a light-diffusing member configured to receive light from the light-emitting unit and to diffuse light in an upward direction with respect to the display assembly. The light-diffusing member may have a bar shape that extends along the display assembly, and the light-emitting unit faces a lateral end of the light-diffusing member at an end region of the display assembly. In some examples, the light-emitting unit includes at least one light-emitting diode configured to emit red light. In some examples, the light-emitting unit may further include a substrate that supports the at least one light emitting diode, that is located inside of the display assembly, and that is coupled to an upper portion of the display assembly.

In some implementations, the display assembly defines a mounting hole at a surface of the display assembly, which is configured to receive the light-diffusing member, where the light-diffusing member has at least one surface exposed to an outside of the display assembly. In some implementations, the light-emitting device may further include at least one fixing hook that is located inside of the display assembly, that is configured to support the light-diffusing member inserted through the mounting hole of the display assembly, and that is configured to detachably couple to the light-diffusing member. In some implementations, the light-emitting device may further include at least one fixing rib that is located inside of the display assembly and that is configured to support at least one side face of the light-diffusing member inserted through the mounting hole of the display assembly.

In some implementations, the door frame defines a light-beam diffusion hole that allows light diffused through a top of the display assembly to transmit to the gap between the edge portion of the door and the front portion of the body. The light-beam diffusion hole may extend toward the gap from a first portion of the door frame to a second portion of the door frame that is located closer to the gap than the first portion, and the light-beam diffusion hole may have a first opening width at the first portion and a second opening width at the second portion, the second opening width being greater than the first opening width. In some implementations, the body defines a front channel that is located at the front portion of the body vertically below the reflective portion and that allows discharge of cooling gas from an upper space of the body to the gap.

According to another aspect, a cooking appliance includes a body that defines a cooking chamber having an opening, a door configured to open and close the opening of the cooking chamber, and a light-emitting device having at least a portion located in the door. The light-emitting device includes a light-emitting member that is located on at least one of the body or the door, that faces a gap defined between an edge portion of the door and a front portion of the body, and that is configured to emit light of a predetermined color in response to operation of the cooking chamber, a reflective portion that extends from the front portion of the body, that is configured to receive light from the light-emitting member through the gap, and that is configured to direct light in a direction away from the door, and a light-diffusing member coupled to the light-emitting member and configured to receive light from the light-emitting member and to diffuse light toward the gap.

Implementations according to this aspect may include one or more of the following features. For example, the cooking appliance may further include a cooling unit configured to supply cooling gas toward the gap to cool the light-emitting member. In some examples, the cooling unit includes at least one rear channel defined in a rear portion of the body and configured to receive cooling gas from an outside of the body, a middle channel defined inside of the body and configured to receive cooling gas introduced through the at least one rear channel and to discharge cooling gas to an upper space of the body, a front channel that is defined in the front portion of the body vertically below the reflective portion and that allows discharge of cooling gas from the upper space of the body to the gap, and at least one blowing fan located in the upper space of the body and configured to cause flow of cooling gas toward the gap. In some implementations, the light-emitting member is located at a surface of the door that faces the gap. In some implementations, the light-emitting member is located at a front surface of the body that faces the gap.

In some implementations, light may be emitted through the gap between the door edge portion and the portion of body front face, unlike the conventional structure in which light is transmitted through the door glass and emitted outside the door. Further, light is guided in a direction set by the reflective portion. Thus, there is an advantage that distortion of the color of light or distortion of light illumination does not occur, which otherwise occurs in the case where light passes through the door glass. Further, since the light-emitting member does not emit light toward the door front face in the direction through the door, the shape and location of the light-emitting member may not be directly exposed out of an exterior appearance of the cooking appliance to the viewer, thereby solving the problem of deteriorated design aesthetics of the cooking appliance.

In some implementations, the reflective portion extends from the portion of the body front face. The reflective portion may have an inclined face reflecting the light-beam emitted from the light-emitting member. As a result, the light-beam emitted from the light-emitting member may be reflected from the reflective portion and then emitted clearly through the gap. In another example, the reflective portion may have a vertical face rather than the inclined face.

In some implementations, the light-emitting member may be disposed adjacent to the gap. In one example, the light-emitting member is disposed in one face of the door and adjacent to the gap. In another example, the light-emitting member is disposed in the front face of the body and adjacent to the gap. That is, as long as the light-emitting member is positioned near the gap, the light emitting member may be disposed on the door or on the body.

In some implementations, the light-emitting device further includes an extension extending from the reflective portion toward the door by a predetermined length. The extension prevents the reflected light beam from the reflective portion from being directing upwardly beyond the body. Thus, the extension may allow the light beam to be prevented from unnecessarily illuminating a surrounding structure around the body. In other words, the extension horizontally extending from the reflective portion toward the door by a predetermined length may allow the light beam to be prevented from unnecessarily illuminating a surrounding structure, such that the light beam having clearness and uniform brightness may be visualized through the gap to the viewer.

In some implementations, the door includes an outer door unit defining a front outer face of the body, wherein the outer door unit defines an outer portion of the door, wherein the outer door unit is free of a portion closing the cooking chamber; and an inner door unit disposed on a rear face of the outer door unit, wherein the inner door unit closes the cooking chamber. Further, the outer door unit further includes a door protrusion protruding outwardly beyond the inner door unit, wherein the door protrusion is free of a face horizontally overlapping the inner door unit. The door protrusion defines the gap with the reflective portion and the extension extending from the portion of the body front face. Thus, the light-emitting member may not be directly exposed from the front of the door to the viewer. Further, light may be diffused through the gap in a mood mode.

In some implementations, the front channel may refer to a last channel which is formed in the portion of the body front face for supplying the cooling gas toward the gap. In one example, the front channel may be formed below the reflective portion. In a specific example, the front channel may be formed between the reflective portion and the opening of the cooking chamber. Locating the front channel at this position may allow the hole of the front channel not be exposed out of an external appearance of the cooking appliance to the viewer so that the appearance aesthetic of the cooking appliance may not be lowered. In addition, since the light-emitting member may be cooled, the heat effect due to the high temperature may be minimized.

The effects of the present disclosure may be as follows but may not be limited thereto.

According to the present disclosure, light is emitted through the gap between the door edge portion and the portion of body front face, unlike the conventional structure in which light is transmitted through the door glass and emitted outside the door. Thus, there is an advantage that distortion of the color of light or distortion of light illumination does not occur, which otherwise occurs in the case where light passes through the door glass. Thus, there is an advantage that clearer light may be visualized.

Further, the reflective portion guides the light beam so that the light-beam emitted from the light-emitting member is directed through the gap out of the appliance. In this connection, the extension prevents the reflected light beam from the reflective portion from being directing upwardly beyond the body. Thus, the extension may allow the light beam to be prevented from unnecessarily illuminating a surrounding structure around the body. Accordingly, light having clearness and uniform brightness may be visualized through the gap. In other words, the extension prevents the light beam from diffusing in the unnecessary direction, and thus emits the light beam only through the gap. Thus, there is an advantage that clearer light may be visualized through the gap.

Furthermore, since the light-emitting member does not emit light toward the door front face in the direction through the door but emits light toward the gap defined between the door edge and the portion of the body front face, the light-emitting member may not be directly exposed out of an exterior appearance of the cooking appliance to the viewer, thereby improving the aesthetics of the cooking appliance. Further, the user may view the emitted light through the gap. Thus, an operation state of the cooking appliance and operation information of the cooking chamber may be intuitively confirmed by the user, thereby improving the user's satisfaction. Furthermore, the light beam may be reflected from the reflective portion and then uniformly diffused through the predetermined gap, thereby to smoothly emit gentle reflected light. This may provide a mood illumination function.

Further, the outer door unit further includes a door protrusion protruding outwardly beyond the inner door unit. The door protrusion defines the gap with the reflective portion and the extension extending from the portion of the body front face. Thus, the light-emitting member may not be directly exposed from the front of the door to the viewer. This improves the design aesthetics of the appliance. Further, a boundary of the gap is clearly defined, thereby further improving the appearance aesthetic.

Further, the body front channel may be formed in the portion of the body front face. The body front channel may cool the light-emitting member formed near the gap by supplying the cooling gas towards the gap.

In particular, the body front channel may be formed in the portion of the body front face and below the refractive portion. In a specific example, the body front channel may be formed between the reflective portion and the opening of the cooking chamber. Thus, the hole of the front channel through which the cooling gas is discharged may not visually be exposed to the viewer out of the appearance of the cooking appliance, thereby improving the design aesthetic feeling of the appliance.

DETAILED DESCRIPTION

Figure 1:
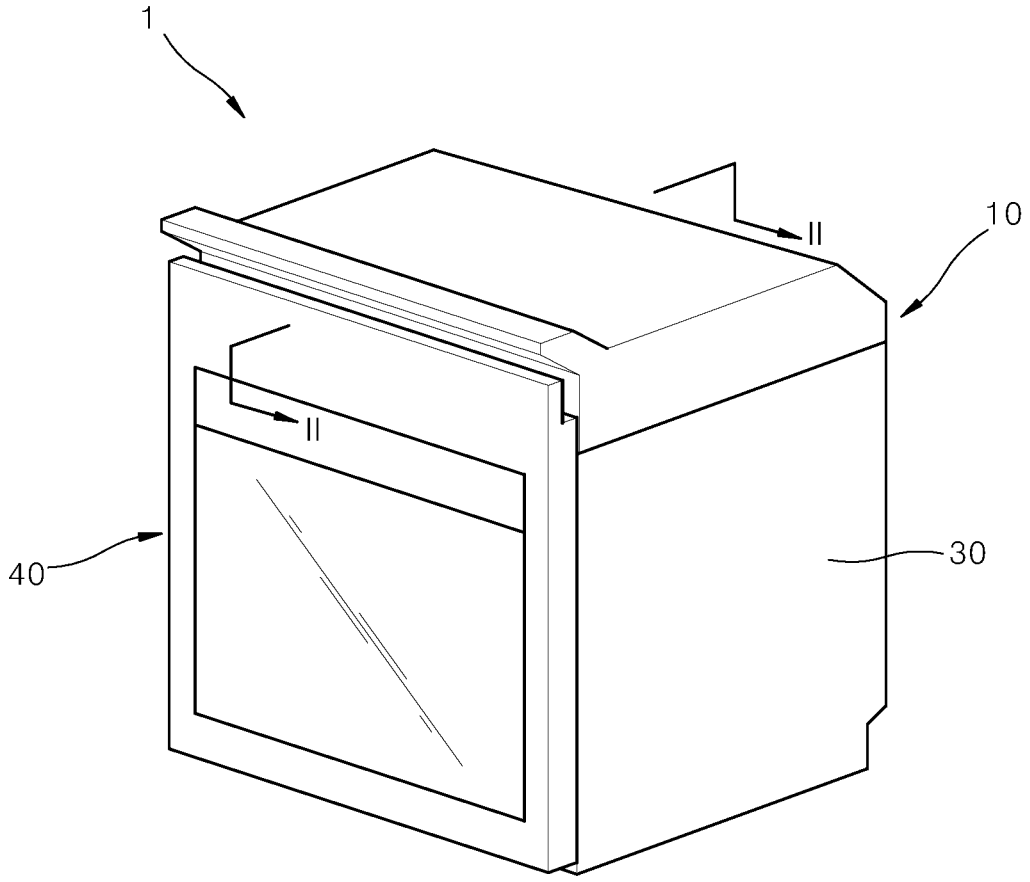
FIG. 1 is a perspective view of an example cooking appliance.

The above objects, features and advantages will become apparent from the detailed description with reference to the accompanying drawings. Implementations are described in sufficient detail to enable those skilled in the art in the art to easily practice the technical idea of the present disclosure. Detailed descriptions of well known functions or configurations may be omitted in order not to unnecessarily obscure the gist of the present disclosure. Hereinafter, implementations of the present disclosure will be described in detail with reference to the accompanying drawings. Throughout the drawings, like reference numerals refer to like elements.

A light-emitting device and a cooking appliance having the same will be exemplified below with reference to a sealed type cooking appliance such as an oven.

First, a brief description will be given of the cooking appliance and an internal configuration thereof.

Figure 2:
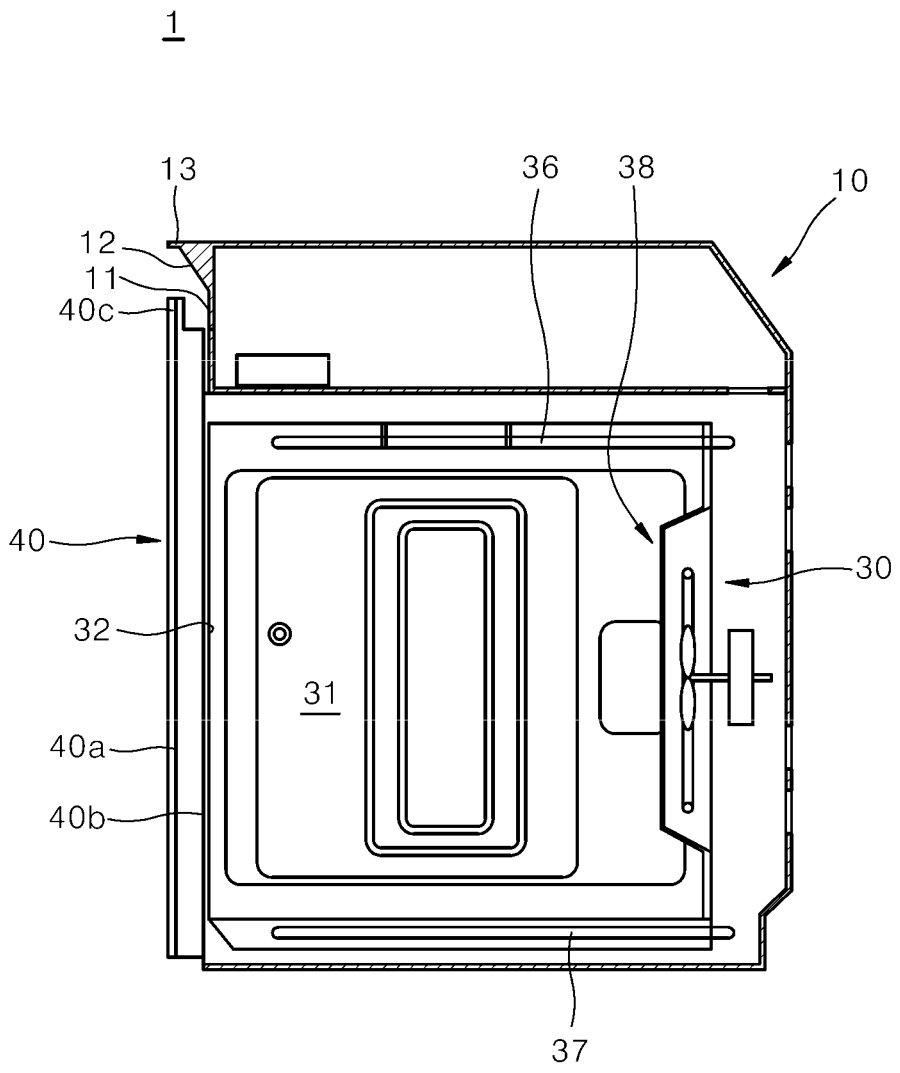
FIG. 2 is a cross-sectional side view showing an example internal configuration of an example cooking appliance.

FIG. 1 illustrates an example cooking appliance. FIG. 2 is a cross-sectional side view showing an example internal configuration of the cooking appliance.

Referring to FIG. 1 and FIG. 2, a cooking appliance 1 has an appearance defined by a body 10.

The body 10 may have a rectangular parallelepiped shape. However, a shape of the body may not be limited thereto and may have various shapes.

Further, the body 10 may have a strength to protect a plurality of parts disposed therein. Therefore, as long as a material of the body has the strength to protect the plurality of parts, the material of the body is not limited particularly.

Further, on a top of the body 10, other cookware such as a cooktop may be installed.

The body 10 may have an oven unit 30 having a cooking chamber 31 defined therein in which food is cooked.

The cooking chamber 31 is defined in the oven unit 30 as shown in FIG. 2.

The cooking chamber 31 refers to a space where food is cooked. Therefore, a container containing food material may be introduced into the cooking chamber 31.

For example, one side face (e.g., a front face) of the cooking chamber 31 is opened while all remaining faces are closed. The chamber may have a box-shaped space The open face (hereinafter, referred to as an "opening") 32 of the cooking chamber 31 may be defined through which the container containing the food material is input into the chamber or cooked food is drawn out of the chamber.

When the container containing the food material is inserted into the cooking chamber 31, the opening 32 of the cooking chamber 31 is blocked by a door 40 (more specifically, an inner door unit 40*b*). Then, heat at a set temperature is applied to the food material put into the shielded inner space, such that the food material is cooked therein.

The oven unit 30 has various heating devices for heating the cooking chamber 31.

For example, as shown in FIG. 2, the heating device for heating the cooking chamber 31 may include an upper heater 36, a lower heater 37, and a convection unit 38.

The upper heater 36 is disposed above the cooking chamber 31 to apply heat to the cooking chamber 31 downwardly. The lower heater 37 is disposed below the cooking chamber 31 to apply heat to the cooking chamber 31 upwardly. The convection unit 38 is disposed behind the cooking chamber 31 and supplies high-temperature air at a predetermined temperature to the cooking chamber 31.

In FIG. 2, the upper heater 36, the lower heater 37, and the convection unit 38 are all shown. However, the present disclosure is not limited thereto. The heating device may include one or more of the upper heater 36, the lower heater 37, and the convection unit 38.

The door 40 is disposed to pivot in a direction to open or close the opening 32 of the cooking chamber 31.

That is, referring to FIG. 2, when the door 40 pivots counterclockwise, the opening 32 of the cooking chamber 31 may be opened. Conversely, when the door 40 pivots clockwise, the opening 32 of the cooking chamber 31 may be closed.

The door 40 includes an outer door unit 40*a* and an inner door unit 40*b*.

The outer door unit 40*a* forms an exterior appearance of the door 40. The outer door unit 40*a* forms a front appearance of the body 10.

The inner door unit 40*b* is disposed on a rear face of the outer door unit 40*a* and closes the cooking chamber.

In this connection, the outer door unit 40*a* has a protruding structure, extending in an outward direction, beyond the inner door unit 40*b*, except for a region that the outer door unit 40*a* faces the inner door unit 40*b*. This protruding structure is called a door protrusion 40*c*.

In some implementations, when the door 40 is closed, a gap 60 (see FIG. 3) is formed between the door protrusion 40*c* and a portion 11 of the front face of the body 10.

The portion 11 of the body front face corresponds to a portion of the front face of the body 10 which does not overlap the opening 32 of the cooking chamber 31.

The portion 11 of the body front face may have a portion extending further outwardly beyond an edge of the door 40.

Figure 3:
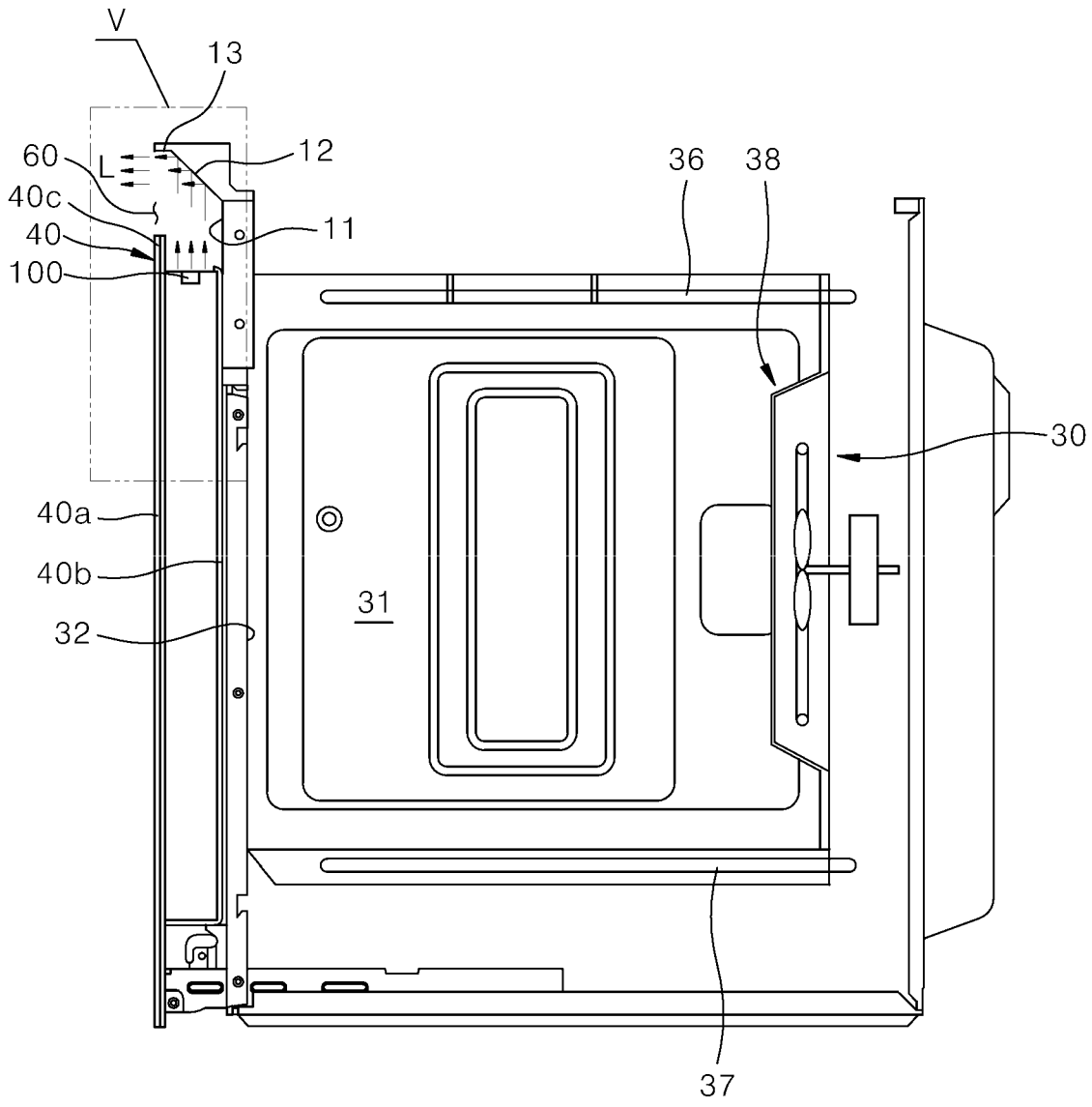
FIG. 3 is a cross-sectional side view of an example door, an example light-emitting device in the door, and an example cooking appliance.

FIG. 3 illustrates an example cooking appliance including an example light-emitting device in a door.

Referring to FIG. 3, the gap 60 is formed between the door 40 and body 10.

Specifically, the gap 60 may be defined as a space between a rear surface of the edge of the outer door unit 40*a* and the portion 11 of the body front face.

For example, the edge of the outer door unit 40*a* has the door protrusion 40*c*.

The door protrusion 40*c* extends from the outer door unit 40*a*. The protrusion 40*c* projects beyond the inner door unit 40*b* in an outward direction (e.g., upward in FIG. 3).

In other words, the door protrusion 40*c* is a portion of the outer door unit 40*a* excluding the portion thereof overlapping the inner door unit 40*b*. The protrusion 40*c* may extend outwardly beyond the inner door unit 40*b*.

The portion 11 of the body front face refers to a portion of the front face of the body 10 that is not overlapped with the opening 32 of the cooking chamber 31.

Referring to FIG. 3, the light-emitting member 100 is positioned within a top of the door 40. Thus, the portion 11 of the body front face extends upwardly beyond the door protrusion 40*c* to define the gap 60 therebetween.

In another example, although not shown separately, the light-emitting member 100 may be located within a side face portion of the door. In this case, the portion 11 of the body front face may extend laterally to define a gap between the portion 11 and the edge portion of the door 40.

In some implementations, the light-emitting member 100 may be located near the gap 60.

Referring to FIG. 3, the light-emitting member 100 may be located in the top of the door 40 and is located close to the gap 60.

In another example, although not shown separately, the light-emitting member 100 may be disposed on the portion 11 of the body front face and near the gap 60. That is, as long as the light-emitting member 100 is positioned near the gap 60, the light-emitting member 100 may be disposed on the door 40 or on the portion 11 of the body front face.

In some implementations, the portion 11 of the body front face further has a reflective portion 12.

The reflective portion 12 extends from the portion 11 of the body front face.

The reflective portion 12 reflects or guides a light-beam L such that the light beam L emitted from the light-emitting member 100 passes through the gap 60 and is directed outwardly of the edge portion of the door 40.

In one example, the reflective portion 12 extends from the portion 11 of the body front face. The reflective portion 12 may have an inclined surface reflecting the light-beam L emitted from the light-emitting member 100. As a result, the light-beam L emitted from the light-emitting member 100 may be reflected from the reflective portion 12 and then emitted clearly through the gap 60.

In another example, the reflective portion 12 may have a vertical surface rather than the inclined surface. This configuration will be illustrated in an example of FIG. 5B.

The light-emitting device may have a different structure from a conventional structure in which light is directly transmitted through a door glass and emitted outside a door.

In some implementations, light is emitted through the gap 60 between the edge portion of the door 40 and the portion 11 of the body front face. The emitted light-beam L is reflected or guided from the reflective portion 12.

This prevents distortion at a color or illumination of a light-beam as otherwise generated from the light directly as transmitted through the glass of the door. Thus, there is an advantage that clearer light may be visualized.

In some implementations, the portion 11 of the body front face further includes the reflective portion 12 and an extension 13.

The extension 13 extends horizontally from the reflective portion 12 toward the door 40 by a predetermined length.

The reflective portion 12 guides light beam L so that the light-beam L emitted from the light-emitting member 100 is directed outwardly of the edge portion of the door 40, i.e., outwardly of the door protrusion 40*c*.

The extension 13 prevents the reflected light beam from the reflective portion 12 from being directing upwardly beyond the body 10. Thus, the light beam is prevented from unnecessarily illuminating a surrounding structure around the body. Accordingly, light having clearness and uniform brightness may be visualized through the gap 60.

For example, when a cooking appliance is placed in a built-in manner, the light-beam L emitted from the light-emitting member 100 located near the gap 60 may be diffused into peripheral furniture adjacent to the cooking appliance, resulting in unnecessary illumination. In the present disclosure, such unnecessary illumination may be prevented.

In some implementations, while the light-emitting member 100 is not exposed to the outside of the door 40, light with a clear color may be uniformly diffused through the predetermined gap 6, thereby to smoothly emit gentle reflected light. This may provide a mood illumination function.

The user may see the emitted light through the gap 60. Thus, an operation state of the cooking appliance and operation information of the cooking chamber may be intuitively confirmed by a user, thereby improving the user's satisfaction.

For example, while the food is cooked by heating the cooking chamber 31, the light-beam L of a set color as emitted by the light-emitting member 100 is emitted to the outside of the cooking appliance through the gap 60 defined between the door protrusion 40*c* and the portion 11 of the body front face. As a result, the user may intuitively confirm outside the cooking appliance whether or not the cooking chamber 31 is operated.

In addition, when light having a color improving appetite of the user may be emitted through the gap 60, effects such as increasing the user's appetite or increasing expectation of cooking may be expected.

A color of the light-beam L emitted from the light-emitting member 100 need not be limited to one color. The light-emitting member 100 may render red-based colors such as red, magenta, orange, etc. to cause an appetite.

Figure 4:
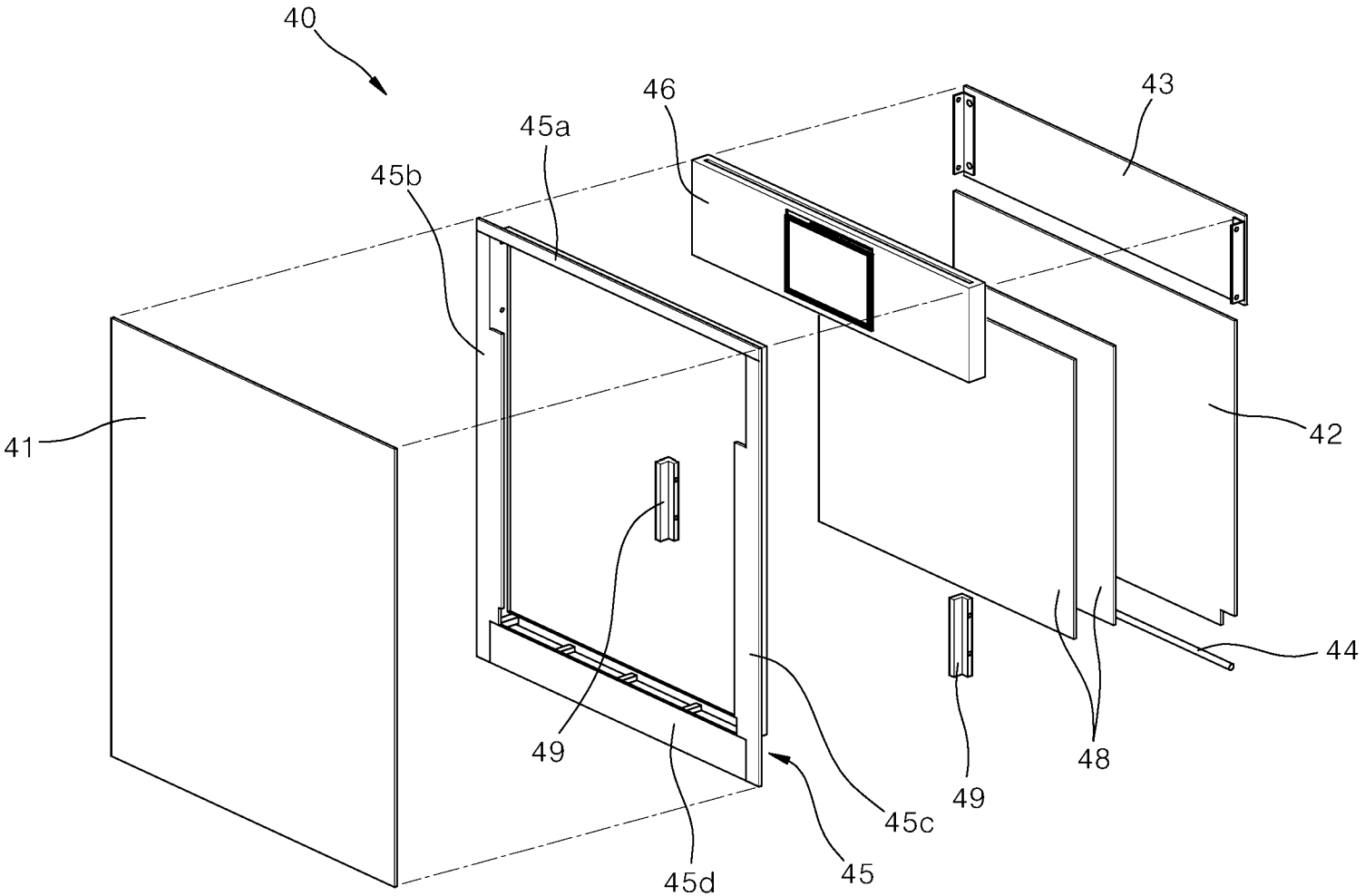
FIG. 4 is an exploded view of an example of a detailed configuration of an example door of an example cooking appliance.

FIG. 4 is an exploded view of an example of a detailed configuration of the door in a cooking appliance.

Referring FIG. 4, the door 40 includes an outer glass 41, an inner glass 42, a door frame 45, and a display assembly 46.

In this connection, a structure comprising the outer glass 41 and forming the appearance of the door 40 may be referred to as the outer door unit 40*a* (see FIG. 3) as described above.

The structure including the display assembly 46 and the inner glass 42 disposed on the rear face of the outer door unit 40*a* (see FIG. 3) and closing the opening 32 of the cooking chamber 31 may be referred to as the inner door unit 40*b* (see FIG. 3).

The door frame 45 may be included in the outer door unit 40*a* (see FIG. 3) or may be included in the inner door unit 40*b* (see FIG. 3), depending on a structural choice.

The outer glass 41 may be a glass member disposed on an outermost side of the door 40 so as to form an outer appearance of the door 40.

The inner glass 42 defines a face opposite to the outer glass 41, i.e., an inner face of the door 40, and is disposed facing the cooking chamber 31 (see FIG. 3). The inner glass 42 closes the opening 32 of the cooking chamber (see FIG. 3).

The inner glass 42 is arranged to be spaced from the outer glass 41 at a predetermined distance. Thus, the door frame 45 may be disposed between the outer glass 41 and the inner glass 42.

The door frame 45 may be interposed between the outer glass 41 and the inner glass 42. The door frame 45 may be a rectangular frame member.

For example, the door frame 45 includes an upper frame 45*a*, a lower frame 45*d*, and lateral frames 45*b* and 45*c*. The upper frame 45*a* defines an upper end of the door 40. The lower frame 45*d* defines a lower end of the door 40. The lateral frames 45*b* and 45*c* define left and right portions of the door 40 respectively.

The display assembly 46 together with the inner glass 42 define the inner door unit 40*b*.

Specifically, the display assembly 46 is disposed at an inner upper position in the door frame 45, that is, below the upper frame 45*a*. Inside the display assembly, a display 46*d* (see FIG. 6) for visually outputting set information may be provided.

The inner glass 42 may be formed to have a relatively small size as compared with the outer glass 41.

The inner glass 42 may be supported, at a bottom thereof, by a separate holder 44, unlike the outer glass 41.

A cover 43 is provided on an upper end of the inner glass 42.

The cover 43 fixes and supports a rear face of the display assembly 46.

In some implementations, under the display assembly 46, two reflective glass 48 may be interposed between the outer glass 41 and the inner glass 42. Below the display assembly 46, a plurality of hinge brackets 49 may be further provided.

Figure 5A:
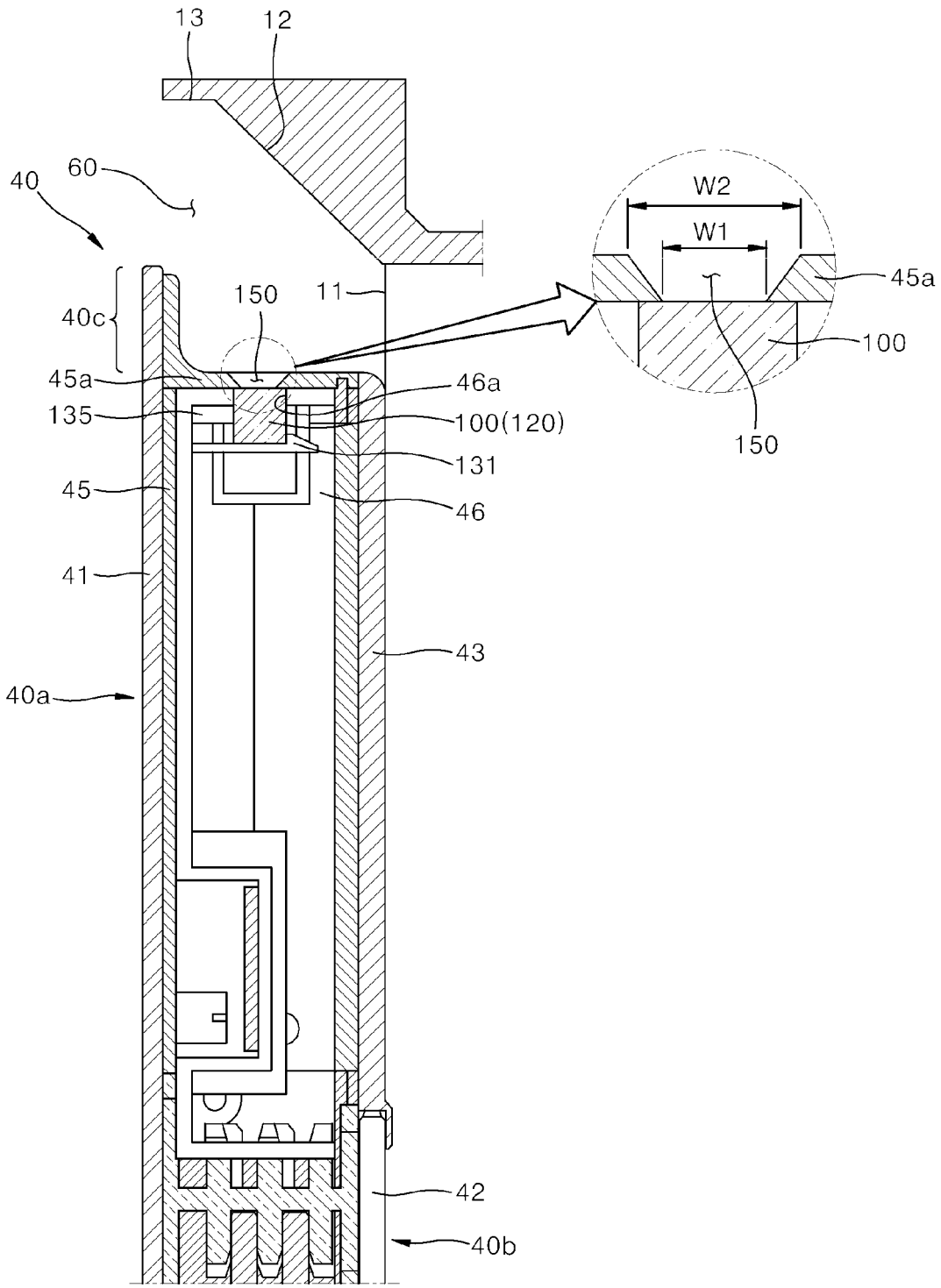
FIGS. 5A and 5B are enlarged views of a V region of FIG. 3.
Figure 5B:
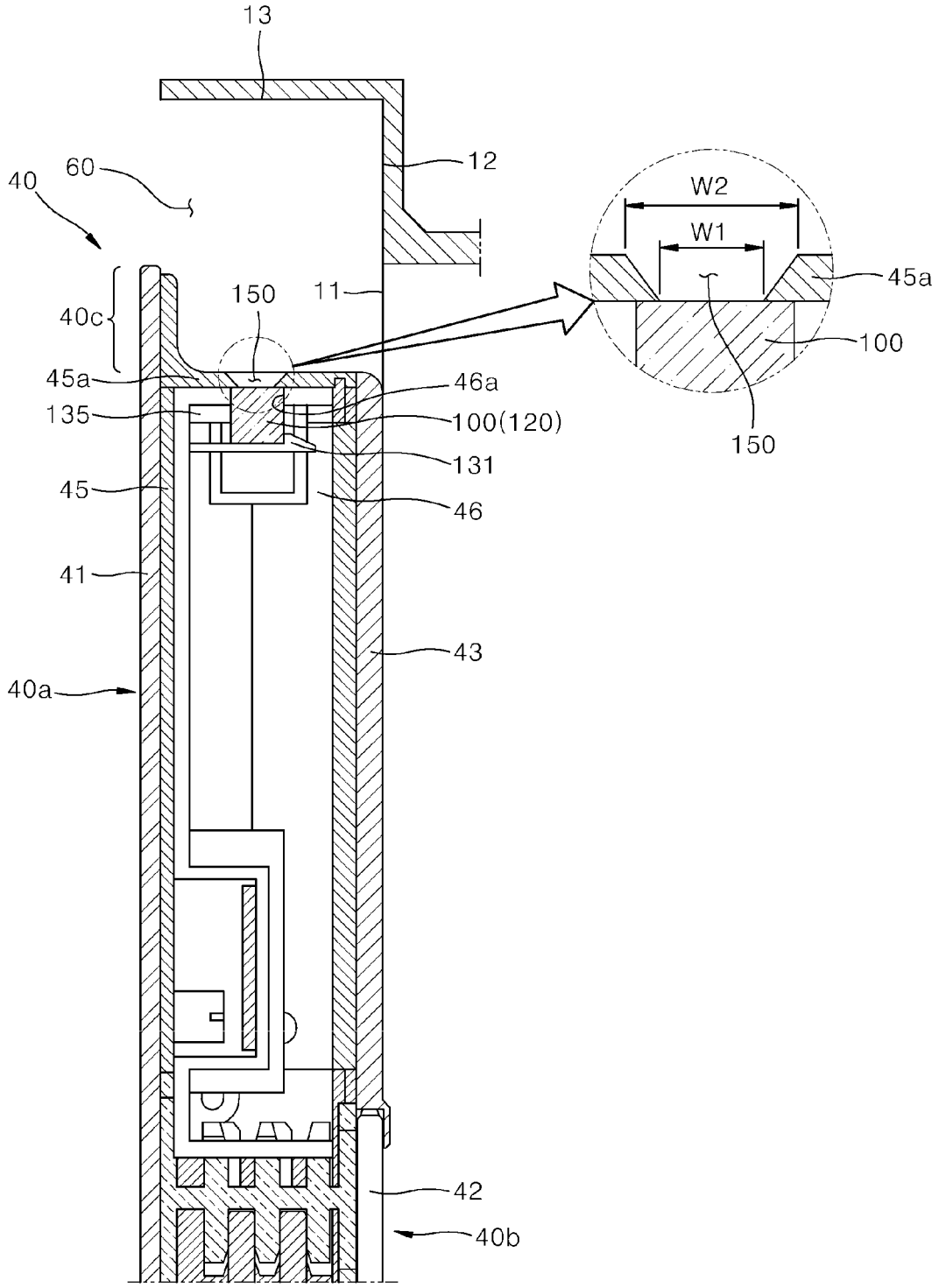

FIGS. 5A and 5B are enlarged views of a V region of FIG. 3 and illustrate cross-sectional views of the door and door light-emitting device in the cooking appliance.

Referring to FIG. 5A, the gap 60 is formed between the door protrusion 40*c* and the portion 11 of the body front face.

The gap 60 may be defined as a space between the edge portion of the door 40, specifically, the door protrusion 40*c* protruding upward from the door 40, and the portion 11 of the body front face.

In this connection, the door protrusion 40*c* refers to a portion of the outer door unit 40*a* that protrudes outwardly beyond the inner door unit 40*b* except for the portion of the outer door unit 40*a* overlapping the inner door unit 40*b*.

In this connection, the portion 11 of the body front face refers to a front face portion of the body 10 excluding a portion of the body front face overlapping the opening 32 of the cooking chamber 31. The portion 11 of the body front face extends a predetermined length upwardly of the door protrusion 40*c* to define the gap 60 with the protrusion 40*c*.

The portion 11 of the body front face further has the reflective portion 12. The reflective portion 12 extends from the portion 11 of the body front face.

The reflective portion 12 reflects or guides a light-beam L such that the light beam L emitted from the light-emitting member 100 passes through the gap 60 and is directed outwardly of the edge portion of the door 40.

The reflective portion 12 extends from the portion 11 of the body front face. The reflective portion 12 may have an inclined surface reflecting the light-beam L emitted from the light-emitting member 100. This is shown in FIG. 5A. As a result, the light-beam L emitted from the light-emitting member 100 may be reflected from the reflective portion 12 and then emitted clearly through the gap 60 defined between the portion 11 and the protrusion 40*c* and eventually may be visible to the user.

In another example as shown in FIG. 5B, the reflective portion 12 may have a vertical surface rather than the inclined surface. Referring to FIG. 5B, the reflective portion 12 may extend in a direction parallel to the door protrusion 40*c*. That is, the reflective portion 12 need not necessarily be limited to the shape of the inclined face shown in FIG. 5A, but rather, may have different shapes.

In some implementations, light is emitted through the gap 60 between the edge portion of the door 40 and the portion 11 of the body front face. The emitted light-beam L is reflected or guided from the reflective portion 12. This prevents distortion at a color or illumination of a light-beam as otherwise generated from the light directly as transmitted through the glass of the door. Thus, there is an advantage that clearer light may be visualized.

In some implementations, the portion 11 of the body front face further includes the extension 13. The extension 13 extends horizontally from the reflective portion 12 toward the door 40 by a predetermined length.

The reflective portion 12 guides light beam L so that the light-beam L emitted from the light-emitting member 100 is directed outwardly of the edge portion of the door 40, i.e., outwardly of the door protrusion 40*c*. In this connection, the extension 13 prevents the reflected light beam from the reflective portion 12 from being directing upwardly beyond the body 10. Thus, the light beam is prevented from unnecessarily illuminating a surrounding structure around the body. Accordingly, light having clearness and uniform brightness may be visualized through the gap 60.

For example, the extension 13 prevents the light beam L from diffusing in an unintended direction after the emitted light-beam L is guided by the reflective portion 12.

In other words, the extension 13 limits the diffusion space of the reflected light-beam, prevents light from diffusing in the unnecessary direction, and thus emits the light beam with clearness and uniform brightness only through the gap 60.

In some implementations, a mounting hole 46*a* is defined in a top of the display assembly 46. The light-emitting member 100 is mounted through the mounting hole 46*a*.

Figure 8:
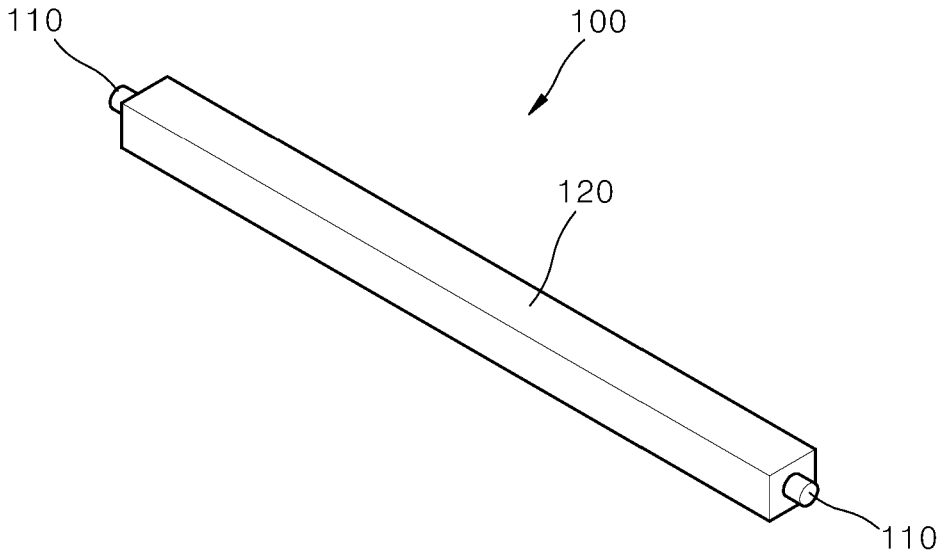
FIG. 8 is a perspective view of an example light-emitting member and an example light-diffusing member of an example light-emitting device.

For example, the light-emitting member 100 includes a light-emitting unit 110 (see FIG. 8) and a light-diffusing member 120 (see FIG. 8). In this connection, the light-diffusing member 120 (see FIG. 8) may be inserted through the mounting hole 46*a*. The light-diffusing member 120 may be exposed to the outside of the display assembly 46.

The display assembly 46 includes at least one fixing hook 131 and at least one fixing rib 135.

The fixing hook 131 supports a lower end of the light-diffusing member 120 inserted through the mounting hole 46*a*, and fixes the light-diffusing member 120 detachably.

The fixing rib 135 supports a side portion of the light-diffusing member 120 inserted through the mounting hole 46*a*, and limits an insertion position of the light-diffusing member 120. As such, the fixing rib 135 structurally reinforces the light-diffusing member 120.

In some implementations, a light-beam diffusion hole 150 may be defined in the door frame 45, and more specifically in the upper frame 45*a*. The light-beam diffusion hole 150 allows light beams diffused through a top of the display assembly 46 to be exposed toward the gap between the door 40 and the body 10.

In a specific example, the light-beam diffusion hole 150 may have a bell-mouth type hole structure in which an opening degree increases as the hole extends from an inner side to an outer side of the upper frame 45*a*.

For example, an inner width W1 of the light-beam diffusion hole 150 at a portion abutting the light-diffusing member 120 may be relatively smaller than an outer width W2 of the light-beam diffusion hole 150 at a portion facing the gap 60. Thereby, the diffusion effect of the light-beam may be improved.

Figure 6:
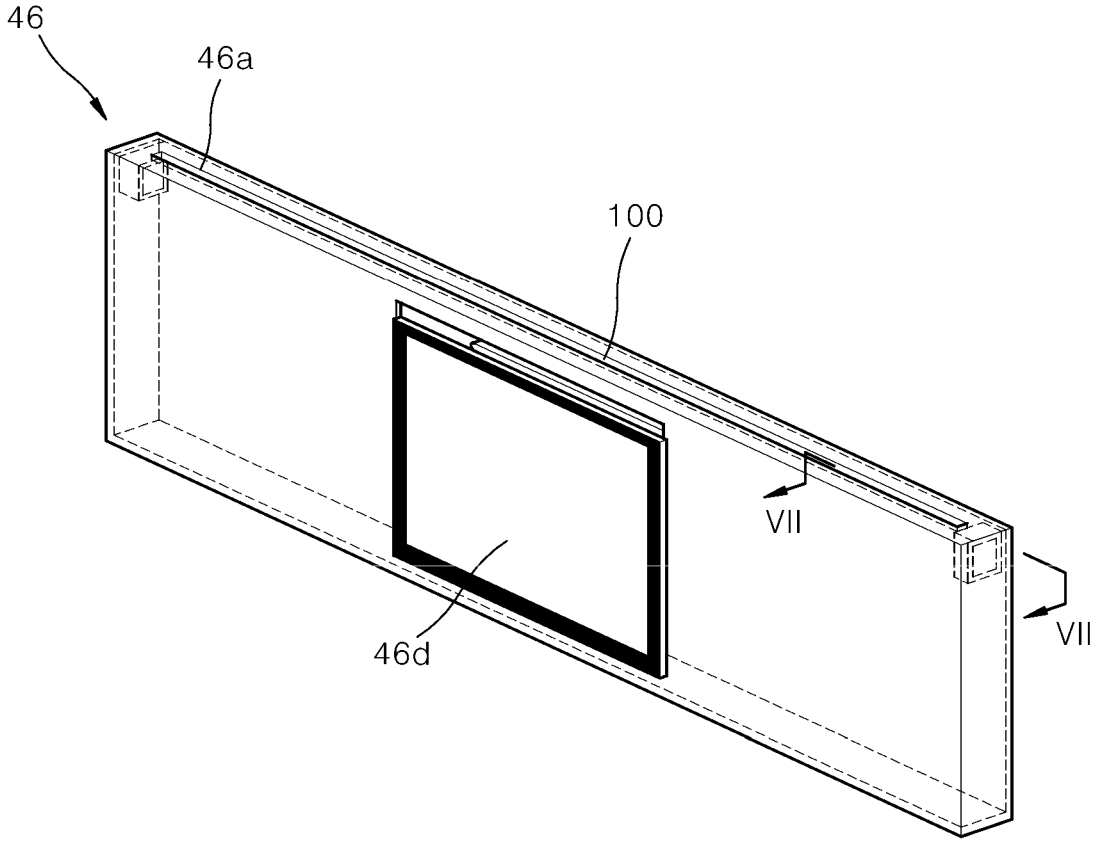
FIG. 6 is an enlarged perspective view showing an example display assembly of the door shown in FIG. 5A.

FIG. 6 is an enlarged view of an example display assembly in a detailed configuration of the door shown in FIG. 5A.

Referring to FIG. 6, the display assembly 46 is a plate-shaped member having a predetermined thickness and having a lateral dimension corresponding to that of the door 40 (see FIG. 4).

In the display assembly 46, a display 46*d* for visually outputting set information is provided.

In the upper end of the display assembly 46, the mounting hole 46*a* defined along the longitudinal direction thereof is defined. The light-emitting member 100 is mounted through the mounting hole 46*a*.

Figure 7:
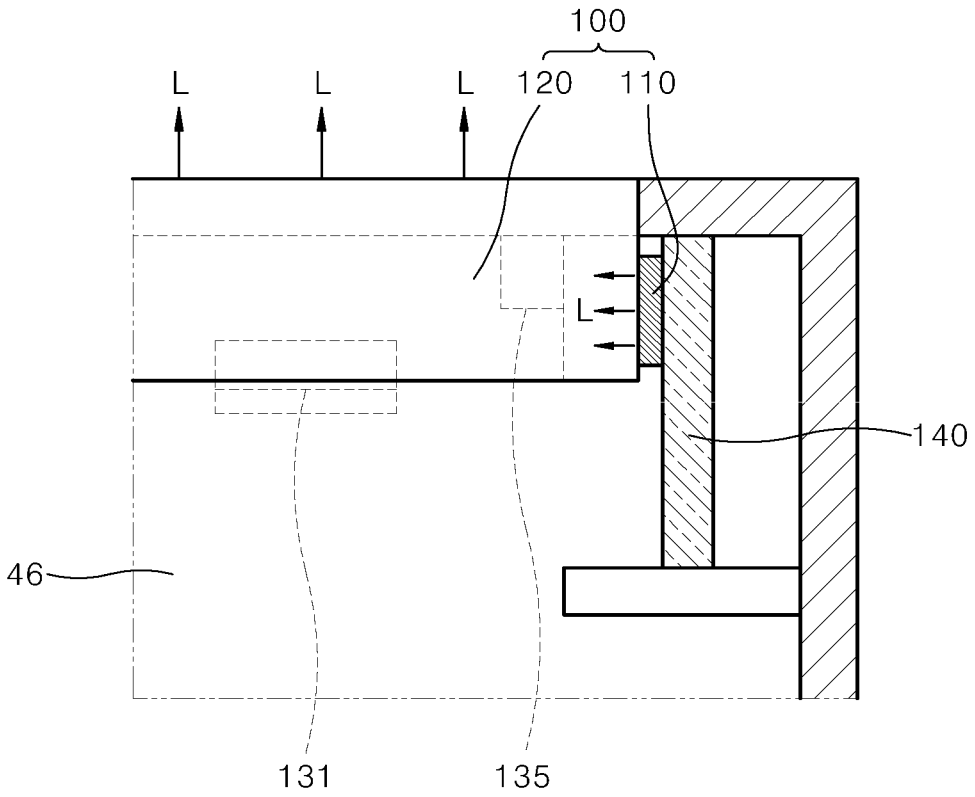
FIG. 7 is a cross-sectional view taken along a line "VII-VII" of FIG. 6.

FIG. 7 is a cross-sectional view taken along a line VII-VII of FIG. 6. FIG. 7 is an enlarged cross-sectional view of an upper portion of the display assembly 46.

Referring to FIG. 7, the light-emitting member 100 includes the light-emitting unit 110 and the light-diffusing member 120.

The light-emitting unit 110 emits a light-beam L of a predetermined color in conjunction with an operation set for the cooking chamber 31 (see FIG. 3).

The light-diffusing member 120 is connected to the light-emitting unit 110. The light-diffusing member 120 receives the light-beam L emitted from the light-emitting unit 110 and diffuses the light-beam L upwardly of the door.

The light-beam L diffused through the light-diffusing member 120 may be emitted to the outside through the gap 60 between the edge portion of the door 40 (see FIG. 5A) and the portion 11 of the body front face.

For example, at least one light-emitting unit 110 may be provided in both lateral ends of the display assembly 46 to emit the light-beam L toward lateral faces of the light-diffusing member 120.

The light-emitting unit 110 includes at least one light emitting diode (LED) that emits red light. In this connection, the red light refers to light having a red-based color such as red, magenta, orange, etc. The color of the light beam is not limited to a specific color.

The light-emitting unit 110 may further include a substrate 140 on which the at least one light emitting diode is mounted.

The substrate 140 may be disposed at an inner upper position of the display assembly 46.

The light-diffusing member 120 may be a bar-shaped member. The light-emitting units 110 may be disposed on both lateral ends of the bar-shaped member respectively.

The light-diffusing member 120 receives, at both lateral ends thereof, light-beams L emitted from the light-emitting unit 110 and diffuses the light-beams L upwardly of the display assembly 46.

For example, the light-diffusing member 120 may be embodied as a bar-shaped member having a rectangular cross section, and a material thereof may be glass or the like. Further, the light-diffusing member 120 made of, for example, a glass may be coated with a material with a color such as white. Thus, the light-diffusing member 120 may diffuse the light-beam L emitted from the light-emitting unit 110 to the outside of the light-diffusing member 120.

In some implementations, referring to FIG. 7, the fixing hook 131 and fixing rib 135 are shown schematically.

The fixing hook 131 supports a lower portion of the light-diffusing member 120 inserted into the inner upper position of the display assembly 46. The fixing hook 131 also allows the light-diffusing member 120 to be detachably fixed.

The fixing rib 135 supports the lateral portion of the light-diffusing member 120 inserted into the inner upper position of the display assembly 46. The fixing rib 135 also allows the light-diffusing member 120 to be inserted into a predetermined position and structurally reinforces the light-diffusing member 120.

Figure 9:
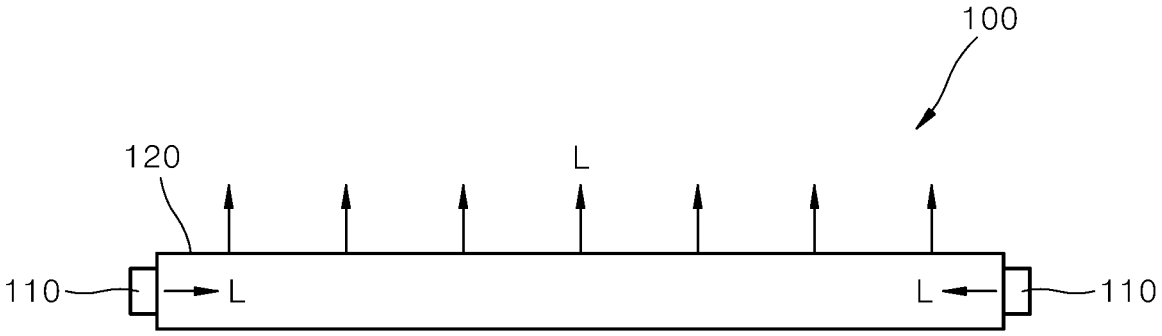
FIG. 9 is a conceptual diagram illustrating example diffusion directions of light through an example light-emitting member and an example light-diffusing member of an example light-emitting device.

FIG. 8 is a perspective view of an example light-emitting member and an example light-diffusing member of an example light-emitting device in an example door. FIG. 9 is a conceptual diagram illustrating an example of diffusion of light of a set color through an example light-emitting member and an example light-diffusing member of an example light-emitting device in an example door.

Referring to FIG. 8 and FIG. 9, the light-emitting member 100 includes the light-emitting unit 110 and the light-diffusing member 120.

The light-emitting unit 110 emits a light-beam L of a predetermined color in conjunction with an operation set for the cooking chamber 31 (see FIG. 3).

The light-diffusing member 120 is connected to the light-emitting unit 110. The light-diffusing member 120 receives the light-beam L emitted from the light-emitting unit 110 and diffuses the light-beam L upwardly of the door.

In one example, at least one light-emitting unit 110 may be provided at both lateral ends of the display assembly 46 to emit the light-beam L toward lateral faces of the light-diffusing member 120.

The light-diffusing member 120 may be a bar-shaped member. The light-emitting units 110 may be disposed on both lateral ends of the bar-shaped member respectively.

The light-diffusing member 120 receives, at both lateral ends thereof, light-beams L emitted from the light-emitting unit 110 and diffuses the light-beams L upwardly of the display assembly 46. In one example, the light-diffusing member 120 may be embodied as a bar-shaped member having a rectangular cross section. Further, the light-diffusing member 120 made of, for example, a glass may be coated with a material with a color such as white.

Figure 10:
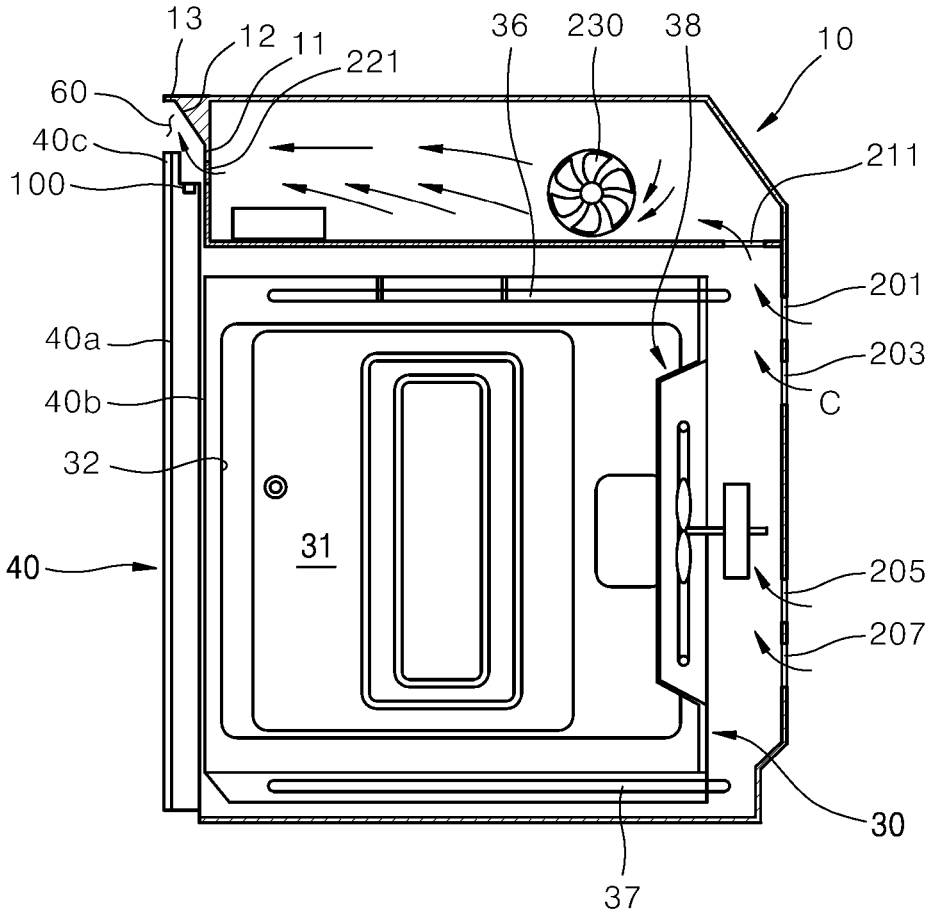
FIG. 10 is a conceptual diagram illustrating an example of operation of an example cooling unit to cool an example light-emitting device located in an example door of an example cooking appliance.

FIG. 10 is a conceptual diagram illustrating an example of operation of an example cooling unit that cools an example light-emitting device in an example door of an example cooking appliance.

Referring to FIG. 10, the cooking appliance 1 includes the body 10 having the cooking chamber 31 defined therein having the front opening 32; the door 40 for opening and closing the cooking chamber 31; and the light-emitting member 100 that emits light in conjunction with an operation set for the cooking chamber 31.

When light is emitted from the light-emitting member 100, the light may be emitted to the outside of the cooking appliance through the gap 60 between the edge portion of the door 40 and the portion 11 of the body front face.

More specifically, the light is emitted through the gap 60 between the door protrusion 40*c* and the portion 11 of the body front face.

The portion 11 of the body front face has the inclined portion 12 that reflects and guides the emitted light. The portion 11 further has the extension 13 extending horizontally from the inclined portion 12 toward the door 40.

The reflective portion 12 guides light beam L so that the light-beam L emitted from the light-emitting member 100 is directed outwardly of the edge portion of the door 40, i.e., outwardly of the door protrusion 40*c*. In this connection, the extension 13 prevents the reflected light beam from the reflective portion 12 from being directing upwardly beyond the body 10 (which is unnecessary). Thus, the light beam is prevented from unnecessarily illuminating a surrounding structure around the body. Accordingly, light having clearness and uniform brightness may be visualized only through the gap 60. That is, the extension 13 prevents the light beam L from diffusing in an unintended direction after the emitted light-beam L is guided by the reflective portion 12. In other words, the extension 13 limits the diffusion space of the reflected light-beam, prevents light from diffusing in the unnecessary direction, and thus emits the light beam with clearness and uniform brightness only through the gap 60.

Thus, during the cooking of the food, in the state that the opening 32 of the cooking chamber 31 is closed by the inner door unit 40*b*, the light beams may be emitted through the gap 60 between the door protrusion 40*c* and the portion 11 of the body front face.

In some implementations, referring to FIG. 10, the light-emitting member 100 is located near the gap 60. In one example, the light-emitting member 100 may be disposed within the top of the door 40.

The light-emitting member 100 may be easily exposed to a high-temperature environment of the cooking chamber 31 that cooks the food material at a high temperature. Therefore, the light-emitting member 100 may be severely subjected to high-temperature thermal influences.

Therefore, there is a need to cool the light-emitting member 100 to a predetermined temperature. The cooking appliance may further include a cooling unit for cooling the light-emitting member 100.

The cooling unit for cooling the light-emitting member 100 injects cooling gas C toward the gap 60 formed between the upper end of the door 40 and the body 10, thereby cooling the light-emitting member 100.

For example, the cooling unit includes body rear channels 201, 203, 205, 207, a body middle channel 211, a body front channel 221, and a blowing fan 230, as shown in FIG. 10.

At least one of the body rear channels 201, 203, 205, and 207 is defined in a rear portion of the body 10 to introduce the cooling gas C into the body 10.

The body middle channel 211 is formed inside the body 10. The body middle channel 211 receives the cooling gas C introduced into the body 10 through the body rear channels 201, 203, 205 and 207 and introduces the gas C into an upper space of the body 10 structurally partitioned from the cooking chamber 31.

The body front channel 221 is formed to extend toward the gap 60 in the upper space of the body 10. The front channel 221 receives the gas C from the middle channel 211 and discharges the cooling gas C into between the edge portion of the door 40 and the portion 11 of the body front face.

In particular, the body front channel 221 may refer to a last channel which is formed in the portion 11 of the body front face for supplying the cooling gas toward the gap 60.

In one example, the body front channel 221 may be formed below the reflective portion 12.

In a specific example, the body front channel 221 may be formed between the reflective portion 12 and the opening 32 of the cooking chamber 31. Locating the body front channel 221 at this position may allow the hole of the body front channel 221 not be exposed to the viewer out of an external appearance of the cooking appliance so that the external appearance aesthetic of the cooking appliance may not be lowered. In addition, since the light-emitting member 100 may be cooled, the heat effect due to the high temperature may be minimized.

In some implementations, at least one blowing fan 230 may be disposed in the upper space of the body 10. The blowing fan 230 is disposed in the upper space of the body 10 to forcedly push the cooling gas C from the upper space of the body 10 toward the door 40.

Thus, in the cooking appliance 1, the light-emitting member 100 may be effectively cooled via the cooling gas through the body rear channels 201, 203, 205, and 207, the body middle channel 211, and the body front channel 221.

The detailed advantageous effects as well as the aforementioned effect have described above with regard to the implementations of the present disclosure. The present disclosure described above may be variously substituted, altered, and modified by those skilled in the art to which the present disclosure pertains without departing from the scope and sprit of the present disclosure. Therefore, the present disclosure is not limited to the above-mentioned exemplary implementations and the accompanying drawings.

What is claimed is:

1. A light-emitting device for a cooking appliance that includes a body that defines a cooking chamber having an opening, and a door configured to open and close at least a portion of the opening of the cooking chamber, the light-emitting device comprising:

a light-emitting member that is located on at least one of the door or the body, that faces a gap defined between an edge portion of the door and a front portion of the body, and that is configured to emit light of a predetermined color in response to operation of the cooking chamber; and a reflective portion that extends from the front portion of the body, that is configured to receive light from the light-emitting member through the gap, and that is configured to direct light in a direction away from the door, wherein the door includes:

an outer door unit that defines an exterior of the door and that is located at an opposite side of the cooking chamber, an inner door unit that is located at a rear side of the outer door unit and that is configured to close the cooking chamber, and a door frame that couples the outer door unit to the inner door unit and that is located between the outer door unit and the inner door unit, wherein the light-emitting device further comprises a display assembly located in an inner upper position of the door frame, and wherein the light-emitting member is mounted in a top of the display assembly.

2. The light-emitting device of claim 1, wherein the light-emitting member is located at a surface of the door that faces the gap.

3. The light-emitting device of claim 1, wherein the light-emitting member is located at a front surface of the body that faces the gap.

4. The light-emitting device of claim 1, further comprising an extension that extends from the reflective portion toward the door.

5. The light-emitting device of claim 1, wherein the outer door unit further includes a door protrusion that protrudes in a first direction further than the inner door unit and that is spaced apart from the inner door unit in a second direction transverse to the first direction.

6. The light-emitting device of claim 1, wherein the outer door unit includes an outer glass that defines a front surface of the door, wherein the inner door unit includes an inner glass that defines a rear surface of the door, that is spaced apart from the outer glass, and that is configured to close the opening of the cooking chamber.

7. The light-emitting device of claim 6, wherein the light-emitting member includes:

a light-emitting unit configured to emit light; and a light-diffusing member configured to receive light from the light-emitting unit and to diffuse light in an upward direction with respect to the display assembly, the light-diffusing member having a bar shape that extends along the display assembly, and wherein the light-emitting unit faces a lateral end of the light-diffusing member at an end region of the display assembly.

8. The light-emitting device of claim 7, wherein the light-emitting unit includes at least one light-emitting diode configured to emit red light.

9. The light-emitting device of claim 8, wherein the light-emitting unit further includes a substrate that supports the at least one light emitting diode, that is located inside of the display assembly, and that is coupled to an upper portion of the display assembly.

10. The light-emitting device of claim 7, wherein the display assembly defines a mounting hole at a surface of the display assembly, the mounting hole being configured to receive the light-diffusing member, and wherein the light-diffusing member has at least one surface exposed to an outside of the display assembly.

11. The light-emitting device of claim 10, further comprising at least one fixing hook that is located inside of the display assembly, that is configured to support the light-diffusing member inserted through the mounting hole of the display assembly, and that is configured to detachably couple to the light-diffusing member.

12. The light-emitting device of claim 10, further comprising at least one fixing rib that is located inside of the display assembly and that is configured to support at least one side face of the light-diffusing member inserted through the mounting hole of the display assembly.

13. The light-emitting device of claim 7, wherein the door frame defines a light-beam diffusion hole that allows light diffused through a top of the display assembly to transmit to the gap between the edge portion of the door and the front portion of the body, wherein the light-beam diffusion hole extends toward the gap from a first portion of the door frame to a second portion of the door frame that is located closer to the gap than the first portion, and wherein the light-beam diffusion hole has a first opening width at the first portion and a second opening width at the second portion, the second opening width being greater than the first opening width.

14. The light-emitting device of claim 1, wherein the body defines a front channel that is located at the front portion of the body vertically below the reflective portion and that allows discharge of cooling gas from an upper space of the body to the gap.

15. A cooking appliance comprising:

a body that defines a cooking chamber having an opening;

a door configured to open and close the opening of the cooking chamber; and a light-emitting device, at least a portion of light-emitting device being located in the door, the light-emitting device comprising:

a light-emitting member that is located on at least one of the body or the door, that faces a gap defined between an edge portion of the door and a front portion of the body, and that is configured to emit light of a predetermined color in response to operation of the cooking chamber, a reflective portion that extends from the front portion of the body, that is configured to receive light from the light-emitting member through the gap, and that is configured to direct light in a direction away from the door, and a light-diffusing member coupled to the light-emitting member and configured to receive light from the light-emitting member and to diffuse light toward the gap, wherein the door includes:

an outer door unit that defines an exterior of the door and that is located at an opposite side of the cooking chamber, an inner door unit that is located at a rear side of the outer door unit and that is configured to close the cooking chamber, and a door frame that couples the outer door unit to the inner door unit and that is located between the outer door unit and the inner door unit, wherein the light-emitting device further comprises a display assembly located in an inner upper position of the door frame, and wherein the light-emitting member is mounted in a top of the display assembly.

16. The cooking appliance of claim 15, further comprising a cooling unit configured to supply cooling gas toward the gap to cool the light-emitting member.

17. The cooking appliance of claim 16, wherein the cooling unit includes:

at least one rear channel defined in a rear portion of the body and configured to receive cooling gas from an outside of the body;

a middle channel defined inside of the body and configured to receive cooling gas introduced through the at least one rear channel and to discharge cooling gas to an upper space of the body;

a front channel that is defined in the front portion of the body vertically below the reflective portion and that allows discharge of cooling gas from the upper space of the body to the gap; and at least one blowing fan located in the upper space of the body and configured to cause flow of cooling gas toward the gap.

18. The cooking appliance of claim 15, wherein the light-emitting member is located at a surface of the door that faces the gap.

19. The cooking appliance of claim 15, wherein the light-emitting member is located at a front surface of the body that faces the gap.

* * * * *